US007686060B2

(12) United States Patent
Anthony

(10) Patent No.: US 7,686,060 B2
(45) Date of Patent: Mar. 30, 2010

(54) RETRACTABLE COVERING FOR ARCHITECTURAL OPENINGS HAVING A PAIR OF FLEXIBLE PARALLEL SHEETS AT LEAST PARTIALLY INTEGRALLY CONNECTED WITH VANES

(75) Inventor: James M. Anthony, Denver, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 276 days.

(21) Appl. No.: 11/845,295

(22) Filed: Aug. 27, 2007

(65) Prior Publication Data

US 2008/0053625 A1 Mar. 6, 2008

Related U.S. Application Data

(60) Provisional application No. 60/824,497, filed on Sep. 5, 2006.

(51) Int. Cl.
*E06B 9/08* (2006.01)

(52) U.S. Cl. ..... 160/121.1; 160/84.05; 160/116; 160/84.03

(58) Field of Classification Search ..... 160/121.1, 160/85, 86, 84.05, 116, 180, 84.03
See application file for complete search history.

(56) References Cited

U.S. PATENT DOCUMENTS 2,140,049 A * 12/1938 Grauel ..... 160/121.1
2,865,446 A * 12/1958 Cole ..... 160/85
4,194,550 A * 3/1980 Hopper ..... 160/121.1
5,419,385 A * 5/1995 Vogel et al. ..... 160/121.1
5,664,613 A * 9/1997 Jelic ..... 160/84.05
6,001,199 A 12/1999 Colson et al.

* cited by examiner

*Primary Examiner*—Blair M. Johnson
(74) *Attorney, Agent, or Firm*—Dorsey & Whitney LLP

(57) ABSTRACT

A retractable covering in accordance with the present invention includes a head rail with a horizontally disposed roller and a pair of depending sheets from the roller which form part of a fabric which can be wrapped around the roller or unwrapped from the roller when moving the covering between retracted and extended positions. The sheets can also be moved with the roller between a closed position wherein they are in contiguous relationship and an open position wherein they are separated while remaining in parallel relationship. A plurality of cut-out vanes are formed in one sheet having a free edge thereof secured as with adhesive or the like to the other sheet. Accordingly, when the sheets are in the closed contiguous relationship, the vanes which are integral with one sheet become coplanar therewith but when the sheets are separated the vanes pivot to open a passage through the sheet from which they were cut to permit the passage of vision and light.

11 Claims, 13 Drawing Sheets

RETRACTABLE COVERING FOR ARCHITECTURAL OPENINGS HAVING A PAIR OF FLEXIBLE PARALLEL SHEETS AT LEAST PARTIALLY INTEGRALLY CONNECTED WITH VANES

CROSS REFERENCE TO RELATED APPLICATION

The present application claims the benefit under 35 U.S.C. §119(e) to U.S. Provisional Patent Application No. 60/824,497 ("the '497 application"), which was filed on Sep. 5, 2006, and entitled Retractable Covering for architectural Openings Having a Pair of Flexible Parallel Sheets at Least Partially Integrally Connected With Vanes." The '497 application is incorporated by reference into the present application in its entirety.

BACKGROUND OF THE INVENTION

1. Field of the Invention

The present invention relates generally to retractable coverings for architectural openings such as windows, doors, archways, or the like, and more particularly to a cellular covering having a pair of parallel flexible sheets interconnected by vanes integral with one of the sheets with the covering being movable between a fully retracted position wherein it is wrapped about a roller and a fully extended position. Further, the covering can be moved in the fully extended position between a closed position where the sheets of material and vanes are contiguous and lie in a common vertical plane and an open position wherein the sheets are parallel but separated with the vanes extending generally horizontally therebetween.

2. Description of the Relevant Art

Retractable coverings have been in common usage for numerous years. Early forms of such coverings included retractable shades where a flexible sheet of material could be retracted around a roller at the top of the architectural opening or extended from the roller across the architectural opening. A more recent and popular form of retractable covering is a venetian blind which includes a plurality of horizontal slats suspended by cord ladders so as to remain in parallel relationship. The cord ladders have a pair of vertical runs interconnected at spaced vertical locations by a plurality of rungs on which a slat is supported. The vertical runs can be shifted in opposite vertical directions to tilt the rungs thereby tilting the slats between open and closed positions when the venetian blind is fully extended. The blind can be retracted adjacent to a top of the architectural opening by gathering the slats in a stack adjacent to the top.

Vertical blinds are another popular form of retractable coverings which operate very similarly to a venetian blind except the slats are suspended vertically rather than horizontally. The slats can be gathered adjacent one side of the opening or extended across the opening and when extended, can be pivoted about vertical axes between open and closed positions.

Another more recent but popular form of cellular retractable coverings includes a pair of sheer fabrics suspended from a roller and interconnected by a plurality of horizontal, continuous, flexible vanes that extend substantially the full width of the opening. The two sheets of sheer along with the vanes can be moved into a vertically extending contiguous relationship and rolled around a roller within a head rail for the covering when retracting the covering. The covering can also be extended from the head rail by unrolling the sheets of material and vanes from the roller. When the sheets and vanes are unrolled, they can be disposed in a closed position where they remain contiguous or the sheets of sheer material can be shifted in opposite vertical directions causing the sheets of sheer material to separate horizontally and allowing the vanes to move from a vertical orientation to a horizontal orientation establishing passages therebetween through which vision and light can pass. In this form of window covering, the vanes are typically formed from a translucent or opaque material whereas the sheer fabrics are somewhat transparent. The edges of the vanes are adhesively or otherwise secured to the sheers so the edges of the vanes move with the attached sheer between the open and closed positions of the covering. An example of such a covering is shown in U.S. Pat. No. 6,001,199, which is of common ownership with the present application.

While this later form of covering has been very popular, variations thereof are desirable to increase the available aesthetics of such a covering and it is to provide additional variations for such a covering that the present invention has been developed.

SUMMARY OF THE INVENTION

The present invention relates generally to a cellular retractable covering for an architectural opening such as a window, door, archway, or the like, wherein a pair of parallel sheets of material are interconnected by a plurality of vanes with the vanes being cut from and thereby integrally connected to one of the sheets of material. A free edge of each vane is adhesively, ultrasonically, or otherwise secured to the other sheet of material. The vanes therefore are made of the same material as the sheet from which they are formed with the sheets of material being the same, different, transparent, translucent, or opaque as desired.

The sheets of material are suspended from a roller in a head rail so the sheets can be retracted about the roller in a retracted position of the covering or unwound from the roller and extended across the architectural opening in an extended position of the covering. In the extended position, the sheets of material can be moved vertically in opposite directions causing the sheets to separate horizontally and allowing the vanes to move from a vertical orientation in a closed position of the covering to a generally horizontal orientation in an open position. In the open position, vision and light can pass through passages through the covering resulting from the cut-out vanes. The vanes can take numerous shapes and can be positioned in patterns or arbitrarily across the covering but the vanes are always formed or cut out of one of the flexible sheets so as to be integrally and hingedly connected to that sheet. The adhesive, ultrasonic, or other system for connecting the opposite edge of each vane to the opposite sheet of material forms another hinged connection so the vanes can be hingedly moved between open and closed positions when the covering is extended.

Other aspects, features, and details of the present invention can be more completely understood by reference to the following detailed description of the preferred embodiment, taken in conjunction with the drawings, and from the appended claims.

DESCRIPTION OF THE PREFERRED EMBODIMENTS

Figure 2:
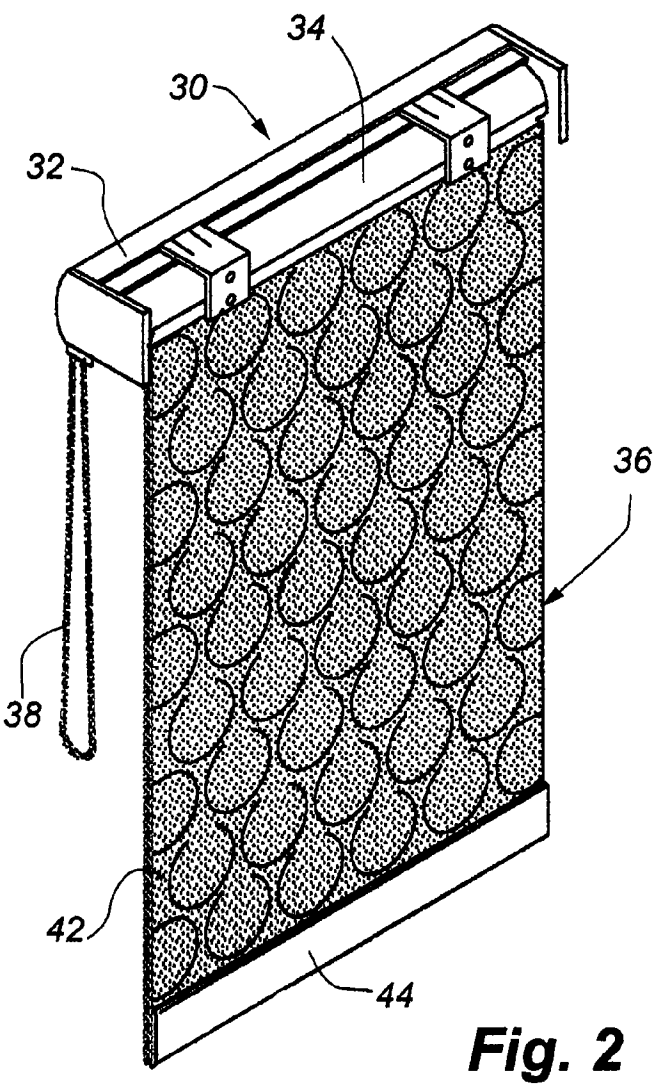
FIG. 2 is an isometric similar to FIG. 1 from the rear of the covering.

The retractable covering 30 of the present invention is probably best appreciated by reference to FIGS. 1-7 where it will be seen the covering includes a head rail 32 having a horizontally disposed reversibly rotatable roller 34 therein and a flexible fabric material 36 suspended therefrom. The flexible fabric material can be wrapped around the roller through use of an endless control cord 38 at one end of the head rail which rotates the roller in reversible directions. In one direction, the fabric material can be wrapped around the roller and in an opposite direction the fabric can be unwrapped from the roller. When wrapped around the roller, the covering is in a retracted position (not shown) and when fully unwrapped from the roller as shown in FIGS. 1-7, the covering is in an extended position.

The fabric 36 for the covering is composed of two flexible sheets of material 40 and 42 and a rigid or semi-rigid bottom rail or ballast 44 interconnecting the two sheets along their lower edge. As will be explained in more detail hereafter with reference to FIGS. 8-10, the top edge 46 of each sheet of flexible material is secured in diametrically opposed longitudinal grooves 48 provided on the roller 34 to facilitate operation of the covering. The two sheets of material will be referred to as a front sheet 40 which faces the interior of the room in which the covering is mounted and a rear sheet 42 even though it will be appreciated with the description that follows the sheets might be reversed depending upon the aesthetics desired for a given installation. The front and rear sheets can also be made of any suitable material that is transparent, translucent, or opaque, and while the sheets could be made of the same material having the same characteristics, in the preferred embodiment, the front sheet 40 is a sheer fabric having substantially transparent characteristics while the rear sheet 42 is more translucent or opaque. Further, the rear sheet has formed therein a plurality of integral generally circular cut-out vanes, tabs, or flaps 50, with the cut line 52 for each vane being substantially circular even though the cut line is discontinuous along a top edge 54 of the vane so as to define a hinge line 56 that functions like a living hinge. Some of the vanes along the side edges of the rear sheet are vertically severed out of necessity and therefore define only a portion of a circle.

As will be appreciated from the description hereafter and by reference to FIGS. 1-7, the cut-out vanes 50 are substantially circular in configuration and are aligned in horizontal rows 58 with vertical columns 60 also being defined. The vanes would not have to be circular as will be appreciated with other embodiments of the invention described hereafter, but for purposes of the first embodiment, the vanes are substantially circular in configuration.

The lower or free edge 62 of each cut-out vane is turned down and secured to the front sheet 40 as with an adhesive 63, ultrasonic bonding, stitching, or the like. A horizontal row 58 of the vanes are aligned so as to resemble a segmented horizontal slat extending substantially the entire width of the covering.

Figure 1:
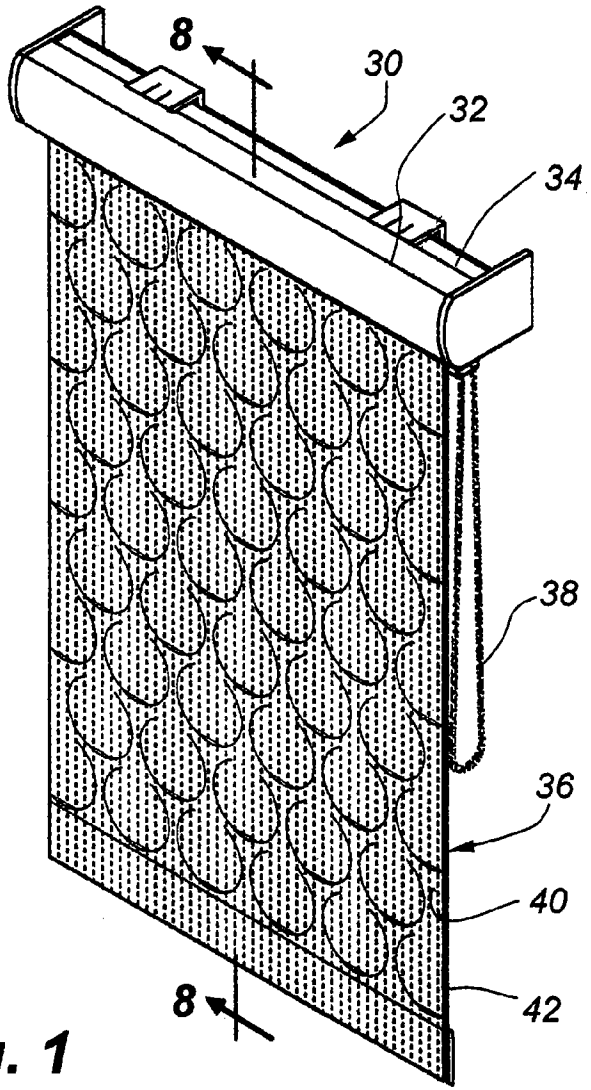
FIG. 1 is an isometric front view of a covering in accordance with the present invention in an extended but closed position.
Figure 3:
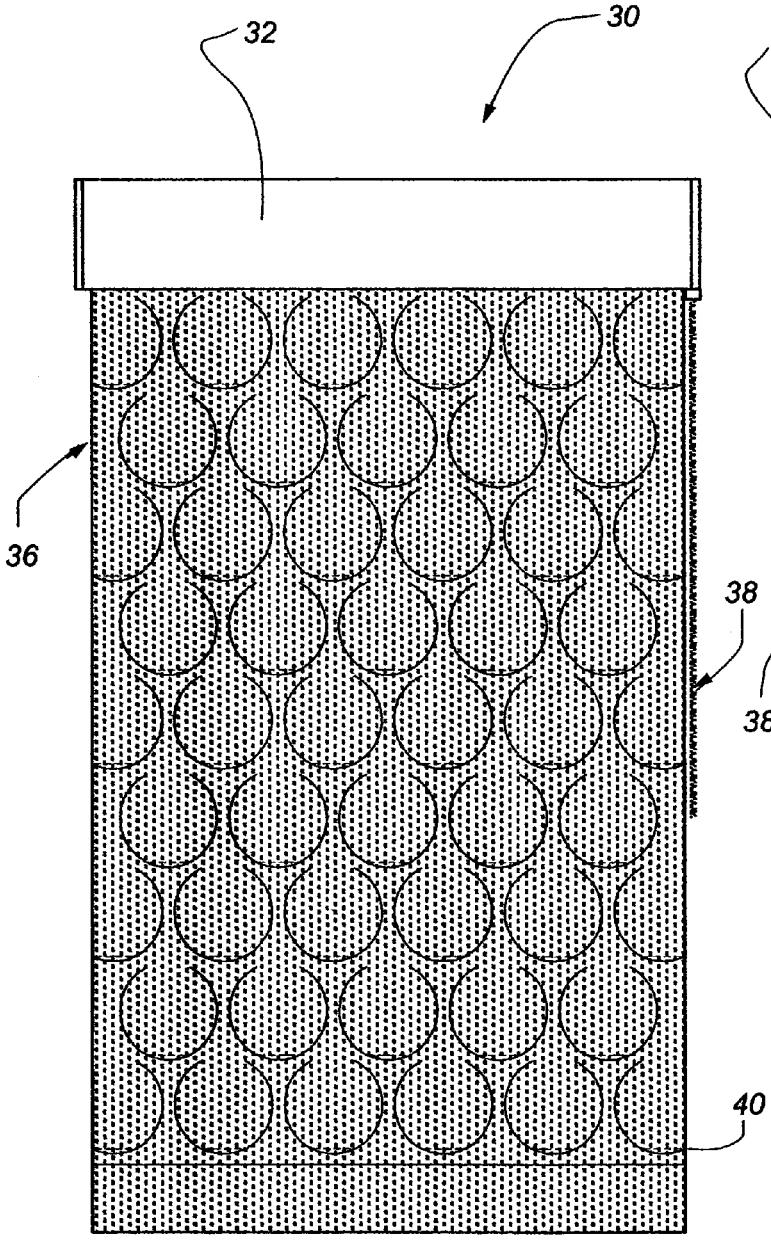
FIG. 3 is a front elevation of the covering as shown in FIG. 1.
Figure 4:
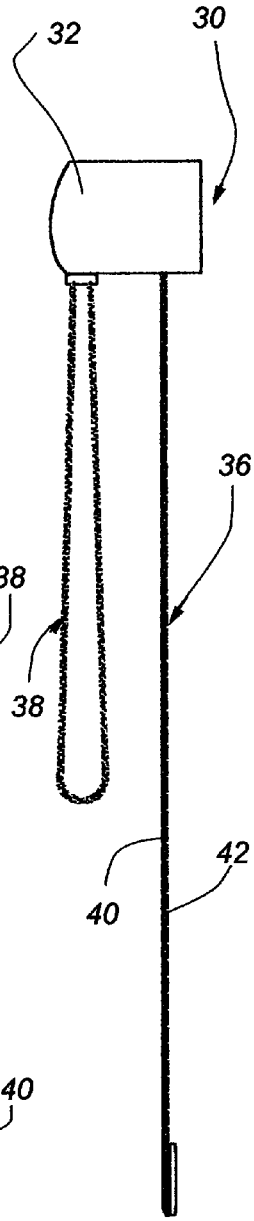
FIG. 4 is a side elevation of the covering as shown in FIG. 3.
Figure 6:
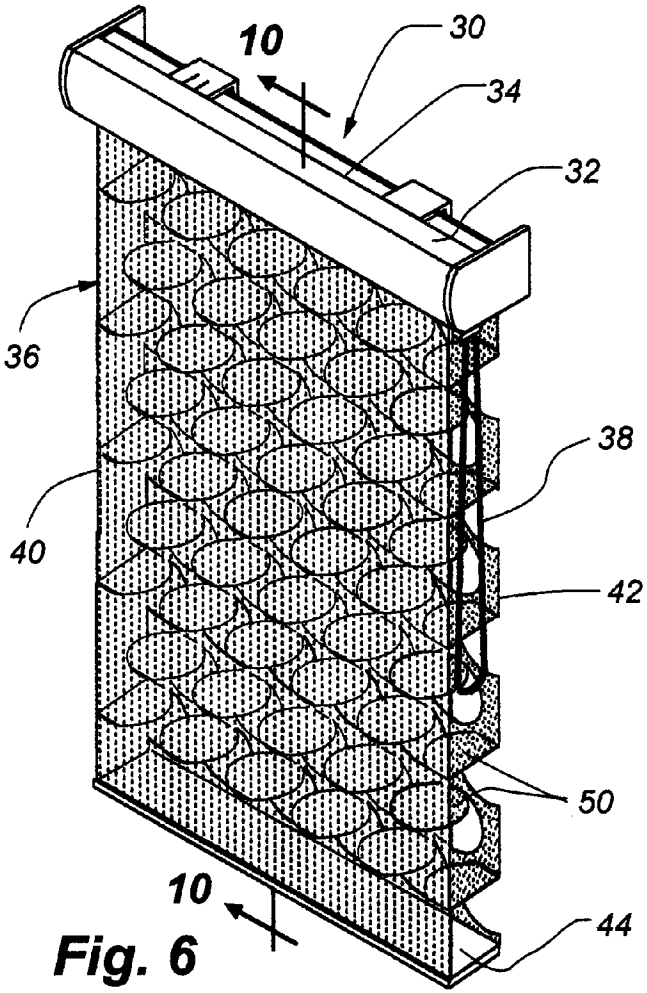
FIG. 6 is an isometric similar to FIG. 5 with the covering in a fully open and extended position.
Figure 5:
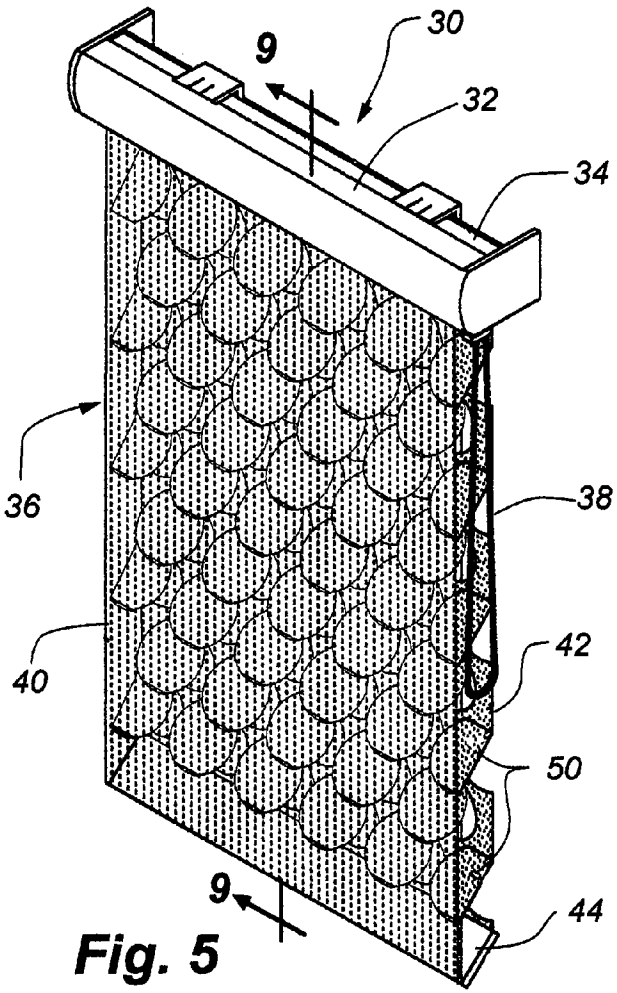
FIG. 5 is an isometric similar to FIG. 1 showing the covering in a partially opened and extended position.
Figure 7:
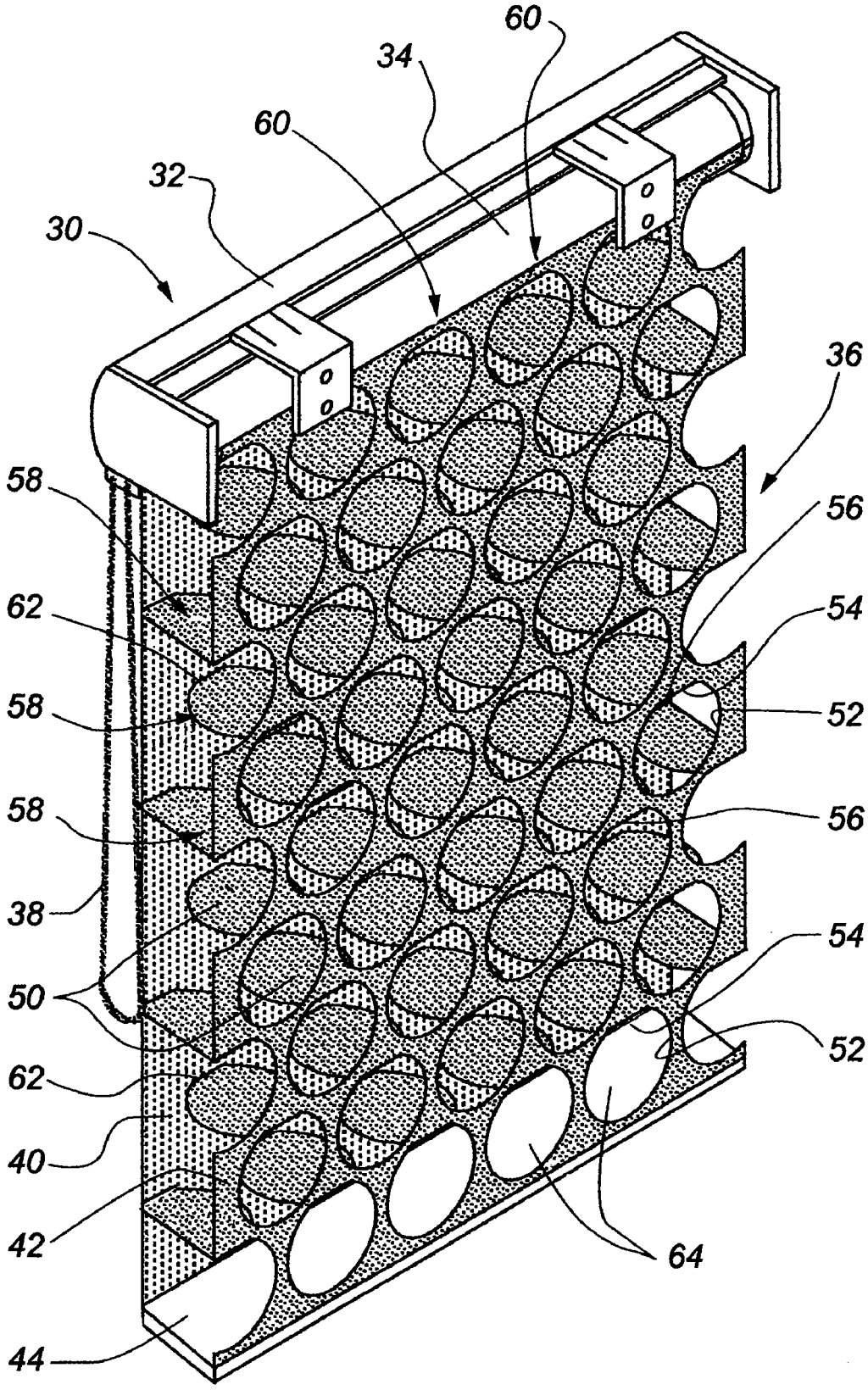
FIG. 7 is an isometric similar to FIG. 6 looking at the covering from the rear side.

The covering 30 in addition to being movable between a retracted position wherein the fabric is wrapped around the roller 34 and an extended position as shown in FIGS. 1-7, is also movable between open and closed positions. In the closed position shown in FIGS. 1 and 2, the front 40 and rear 42 sheets of material are positioned in contiguous relationship and the vanes 50 are positioned or tucked into their cut-out holes or passages 64 in the rear sheet in a depending vertical orientation so as to be coplanar with the rear sheet and contiguous with the front sheet. The front and rear sheets are placed in the closed position by shifting the sheets 40 and 42 in opposite vertical directions as will be explained in more detail hereafter which also shifts the rigid or semi-rigid bottom rail 44 from a horizontal orientation it assumes in the open position of the covering, as shown in FIGS. 6 and 7, to a vertical position when the covering is closed as shown in FIGS. 1 and 2. As will be appreciated, from the front of the covering as shown in FIG. 1, the front sheet 40 in the closed position overlies the bottom rail 44 so as to somewhat conceal it from view even though when the front sheet is somewhat transparent. Inasmuch as the front sheet is somewhat transparent, an outline of the bottom rail is visible through the front sheet as well as an outline of the vanes 50 formed in the rear sheet 42.

When the covering 30 is moved from the closed position of FIGS. 1 and 2 to the open position of FIGS. 6 and 7, the front 40 and rear 42 sheets are shifted in a reverse vertical direction from that in which they are moved into the closed position so the bottom rail 44 is pivoted to a horizontal orientation to thereby help in horizontally separating the front and rear sheets and in doing so pivoting the vanes 50 which are integrally hinged to the rear sheet and adhesively or otherwise hinged to the front sheet. In the open position, it will be appreciated the vanes assume a somewhat horizontal orientation as they have been pivoted about the hinge line 56 thereby opening the passage 64 through the rear sheet where the vane was cut out.

Figure 11:
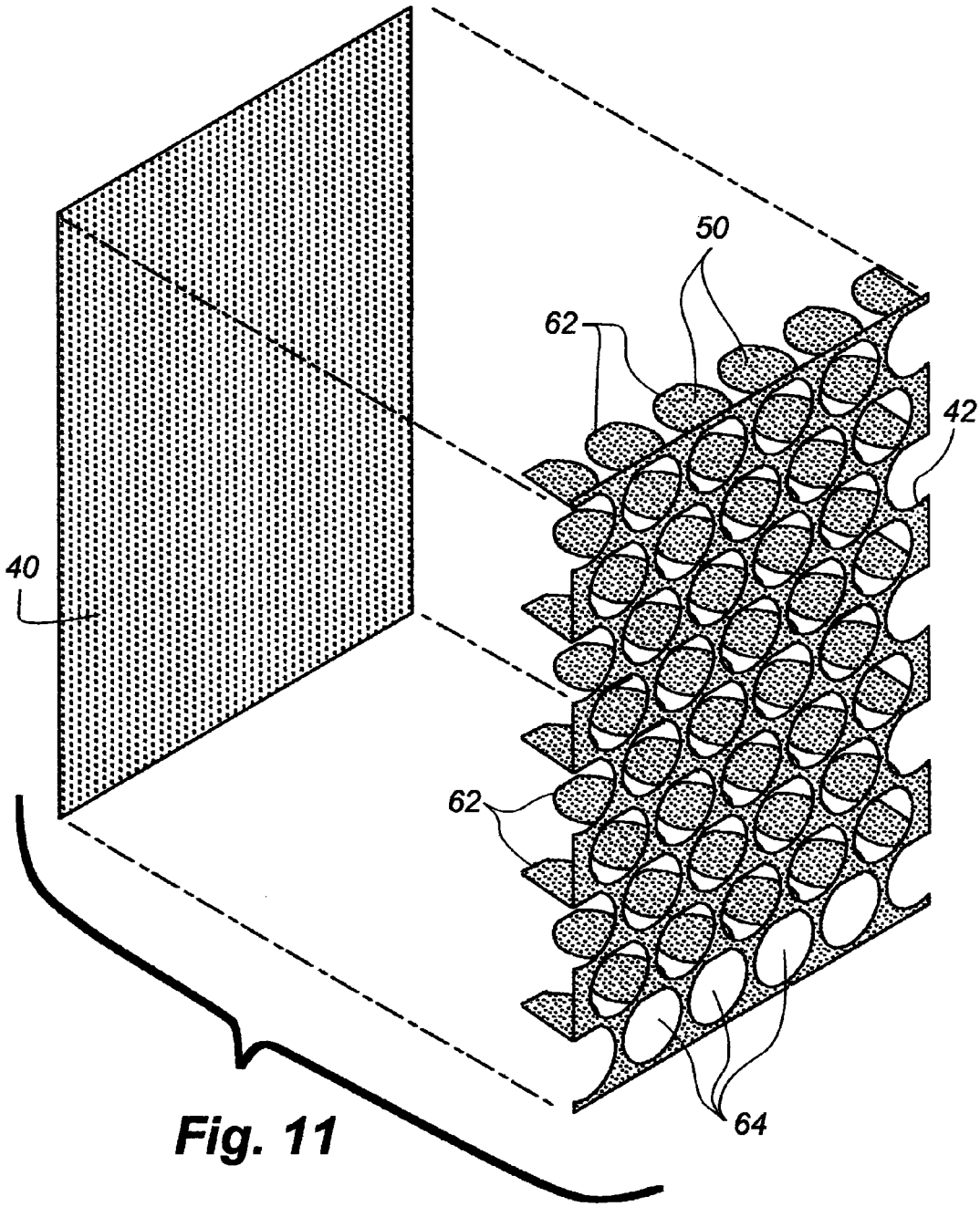
FIG. 11 is an exploded isometric showing the covering as illustrated in FIG. 7.

FIG. 11 is an exploded view similar to FIG. 7 where the vanes 50 and their integral connection to the rear sheet 42 are illustrated. The vanes, of course, are in an open horizontal position with their lower downturned free edges 62 secured to the front sheet 40 as with adhesive, ultrasonic bonding, or the like.

Referring to FIGS. 8-10*a*, the operation of the covering 30 in moving the covering between the aforenoted open and closed positions is best illustrated. As appreciated by reference to FIGS. 8, 9, and 10, the roller 34, as mentioned previously, has diametrically opposed inturned grooves or channels 48 of C-shaped cross-sectional configuration in which a top edge 46 of the front or rear sheet can be secured. In practice, the top edges of the front 40 and rear 42 sheets are hemmed and inserted into the C-shaped grooves and retained therein with longitudinally extending cylindrical retention rods 66. Also as mentioned previously, the grooves 48 for anchoring the front and rear sheets are diametrically opposed and the diameter of the roller 34 is predetermined to conform with the desired separation of the front and rear sheets when the covering is in an open position. It will also be appreciated the separation between the sheets is consistent with the height of a vane 50 when the covering is closed so when the grooves anchoring the front and rear sheets are horizontally aligned as in FIG. 10, the vanes can be substantially horizontally disposed.

Figure 8:
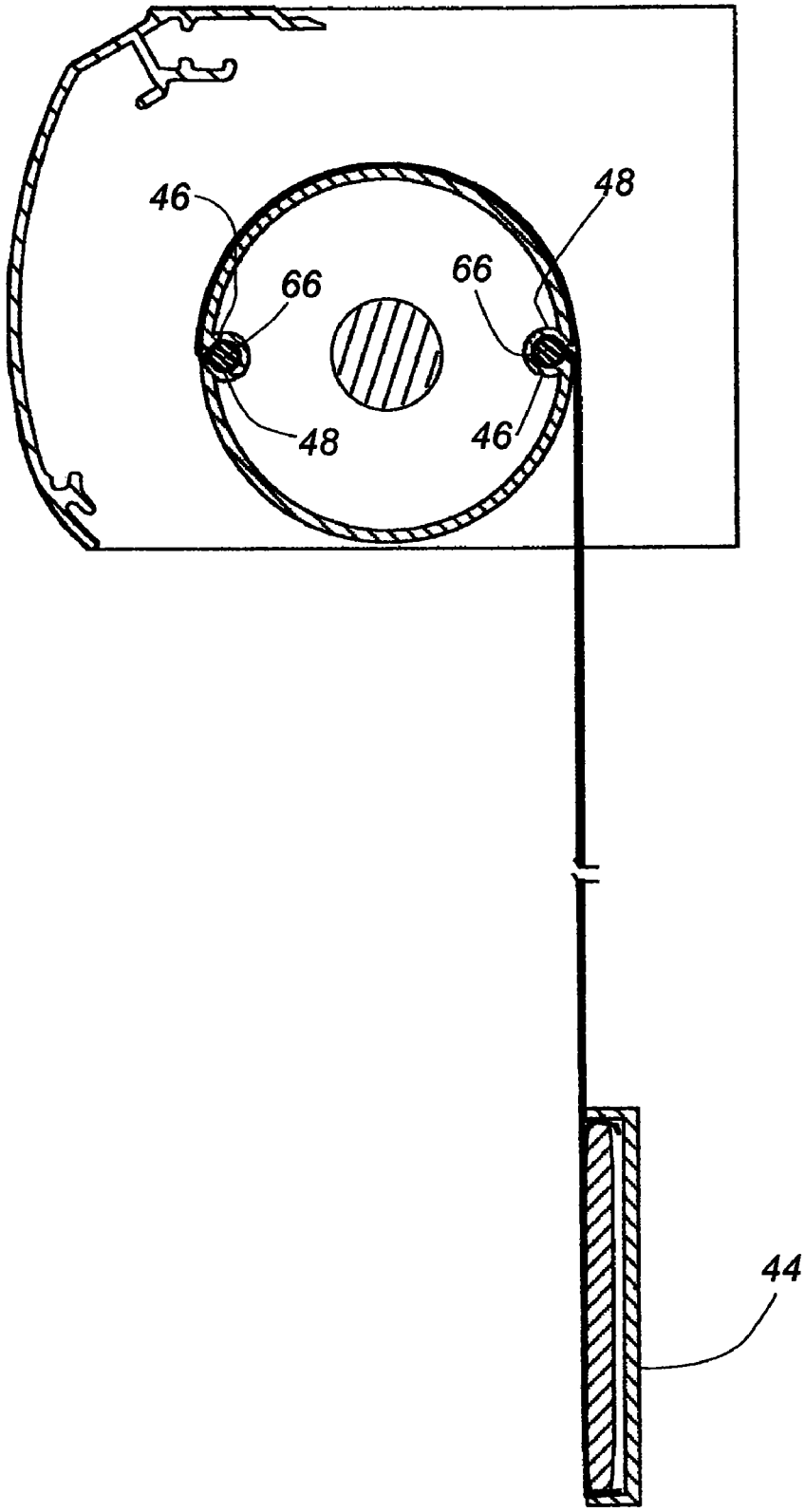
FIG. 8 is an enlarged vertical section taken along line 8-8 of FIG. 1.
Figures 9, 9A:
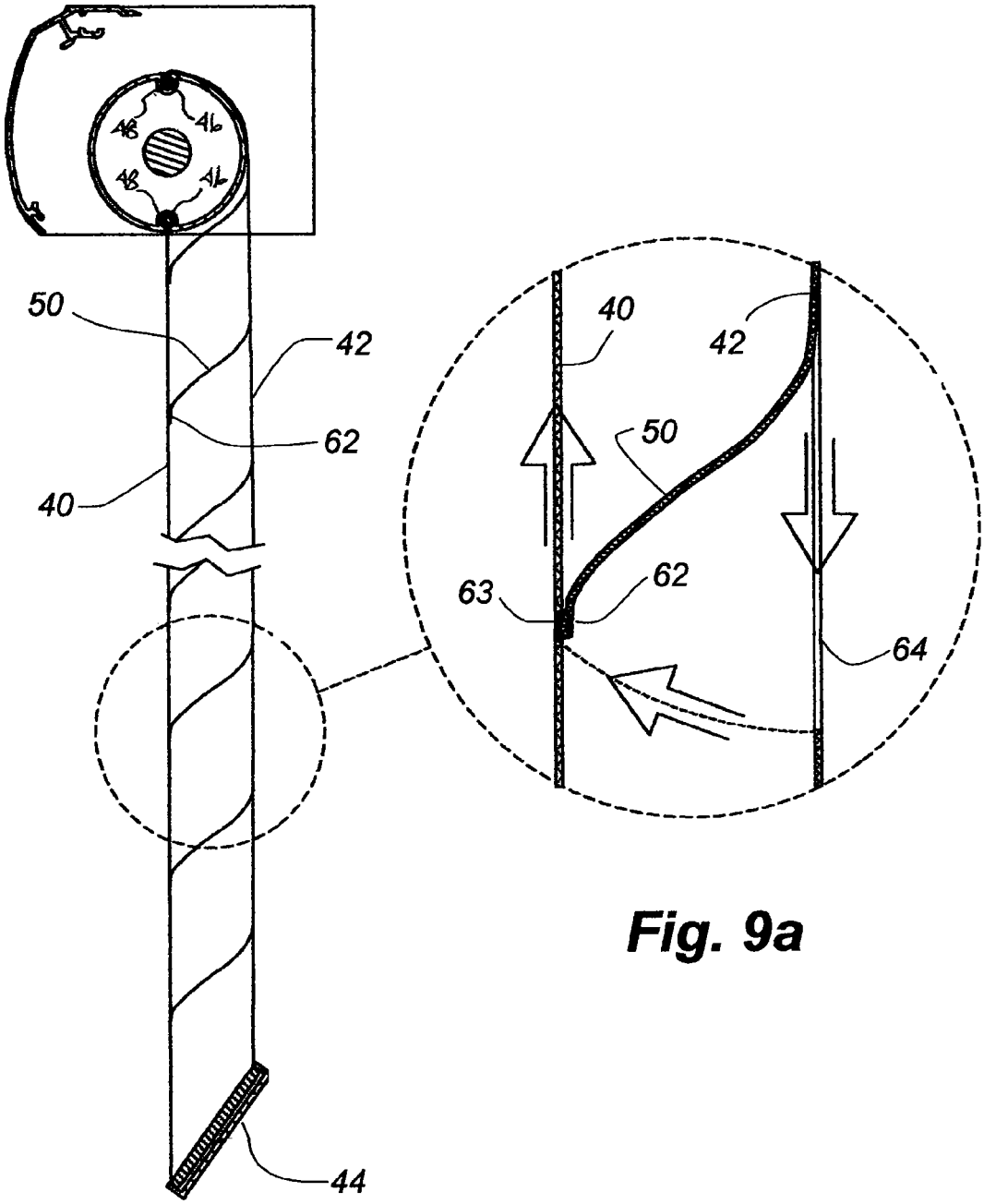
FIG. 9 is an enlarged vertical section taken along line 9-9 of FIG. 5.
FIG. 9*a* is an enlarged view illustrating the portion of FIG. 9 shown in circular dashed lines.
Figures 10, 10A:
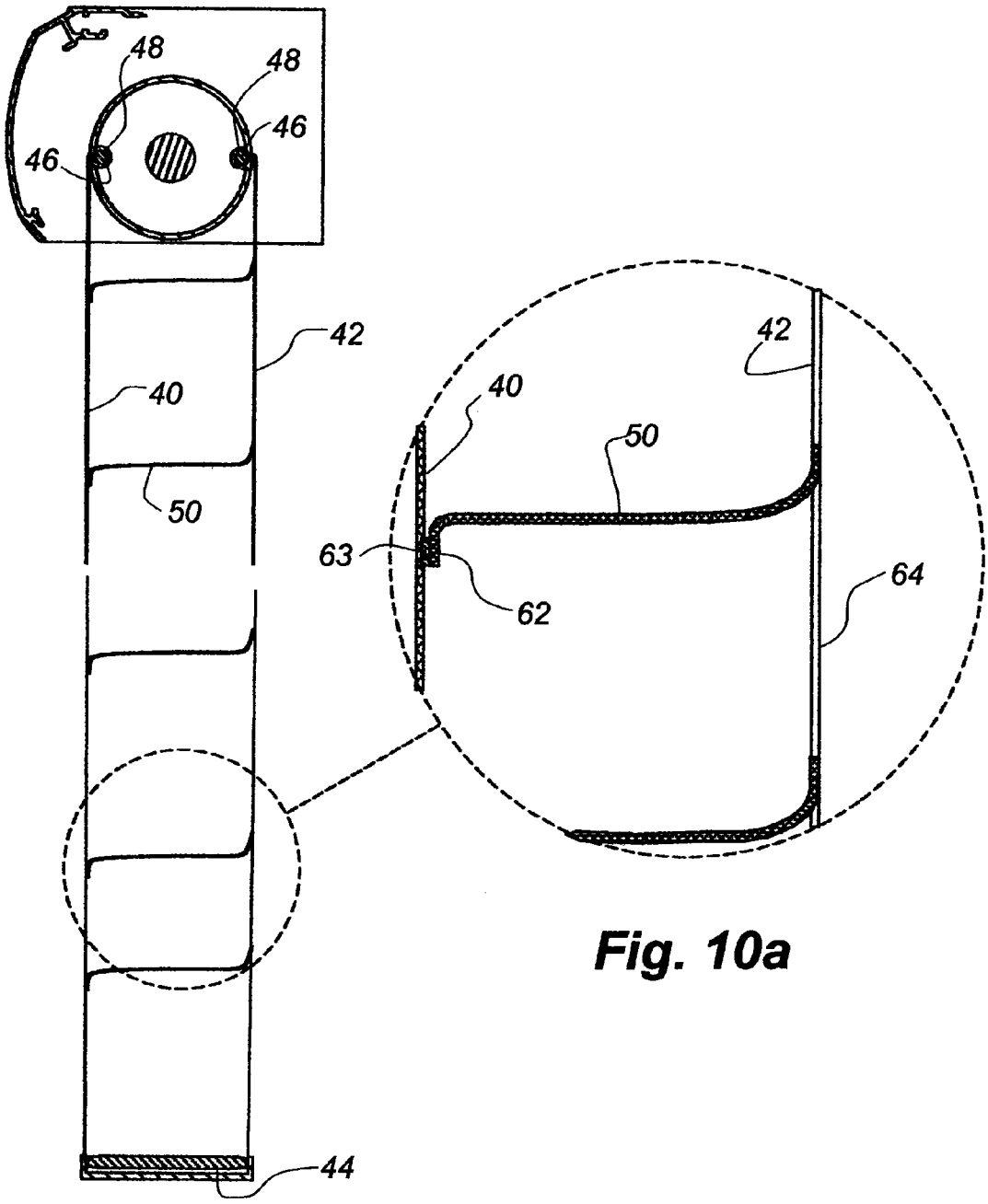
FIG. 10 is an enlarged vertical section taken along line 10-10 of FIG. 6.
FIG. 10*a* is an enlarged section showing the portion of FIG. 10 shown in circular dashed lines.

In operation, when the covering 30 is fully extended and fully open as in FIG. 6 or FIG. 10, the roller 34 is rotated in a counterclockwise direction to move the covering initially to the closed position and ultimately to a retracted position. As can be seen in FIG. 9, after the roller has been rotated counterclockwise through 90 degrees, the front 40 and rear 42 sheets have moved closer together and the vanes 50 are pivoting toward the fully closed position of FIGS. 1 and 2. Further rotation of the roller another 90 degrees in a counterclockwise direction places the sheets and vanes in the position of FIG. 8 where the front and rear sheets are contiguous with each other and the vanes are fully closed and tucked into the cut-out holes or passages 64 from which they came. In the position of FIG. 8, the covering is still fully extended as in FIGS. 1 and 2, but as will be appreciated, if the roller is continued to be rotated in a counterclockwise direction, the fabric 36 will wrap around the roller until it is fully retracted and confined within the head rail 32. Of course, to extend the covering, the roller is simply rotated in a clockwise direction so it initially unwinds from the roller until it assumes the fully extended position of FIG. 8 and further clockwise rotation then opens the covering to the position of FIG. 10 with the vanes extending horizontally between the separated front and rear sheets.

In the enlarged FIGS. 9*a* and 10*a*, the vanes 50 can be seen to be integral with the rear sheet 42 along an upper edge thereof and adhesively secured to the front sheet 40 along the lower downturned free edge 62. Accordingly, in reality, the vanes assume a somewhat S-shaped, horizontally disposed orientation when the vanes are open. When the vanes are closed, of course, they are flat, vertically oriented, and coplanar with the rear sheet out of which they are cut.

Figure 13:
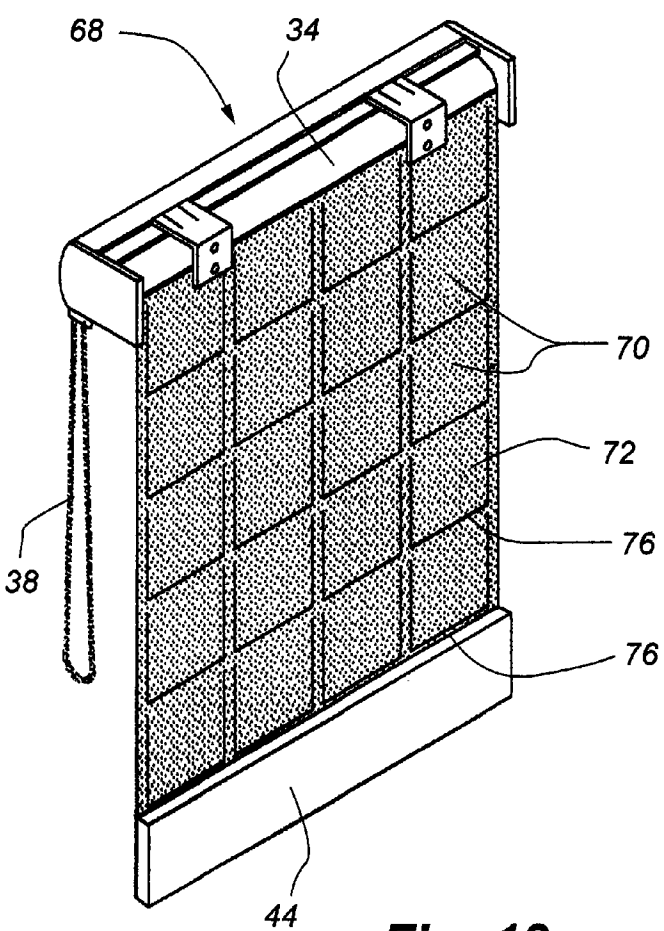
FIG. 13 is an isometric of the covering shown in FIG. 12 as viewed from the rear side.
Figure 12:
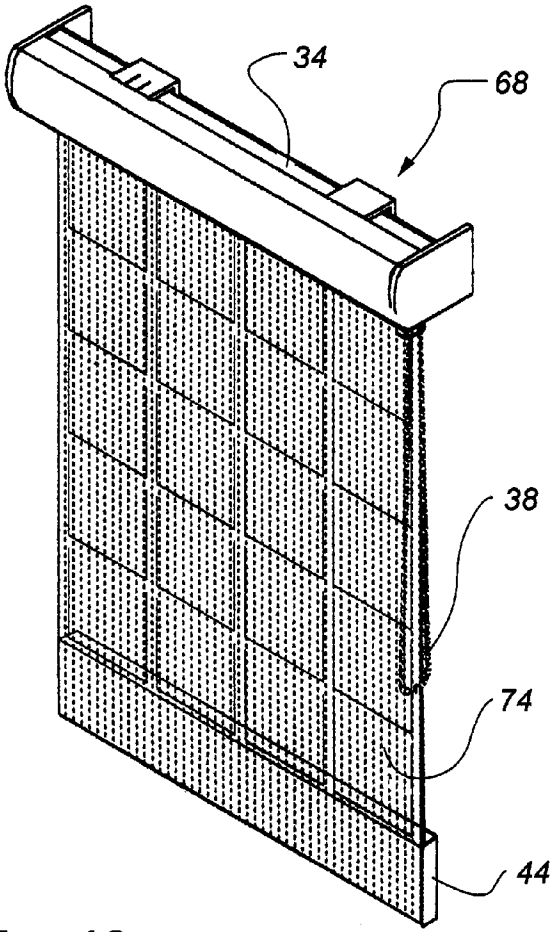
FIG. 12 is a front isometric of a second embodiment of the covering of the present invention showing the covering in an extended and closed position.

Referring to FIGS. 12-15, a second embodiment 68 of the invention is illustrated which is identical to the first embodiment except instead of circular cut-out vanes 50, the rear sheet 72 has quadrangular and, in the disclosed embodiment, square configured cut-out vanes 70. FIGS. 12 and 13 show the front and rear, respectively, of the covering 68 in its fully extended and closed position where the cut-out vanes 70 can be seen but are coplanar with the rear sheet 72, and the rear sheet and front sheet 74 are contiguous with each other. Further, the bottom rail 44 is oriented vertically with the front sheet covering the bottom rail in the front isometric view of FIG. 12. The operation of the covering is identical to that previously described with the roller 34 and an endless control cord 38 for rotating the roller in reversible directions to open and close the covering and move it between extended and retracted positions.

Figure 15:
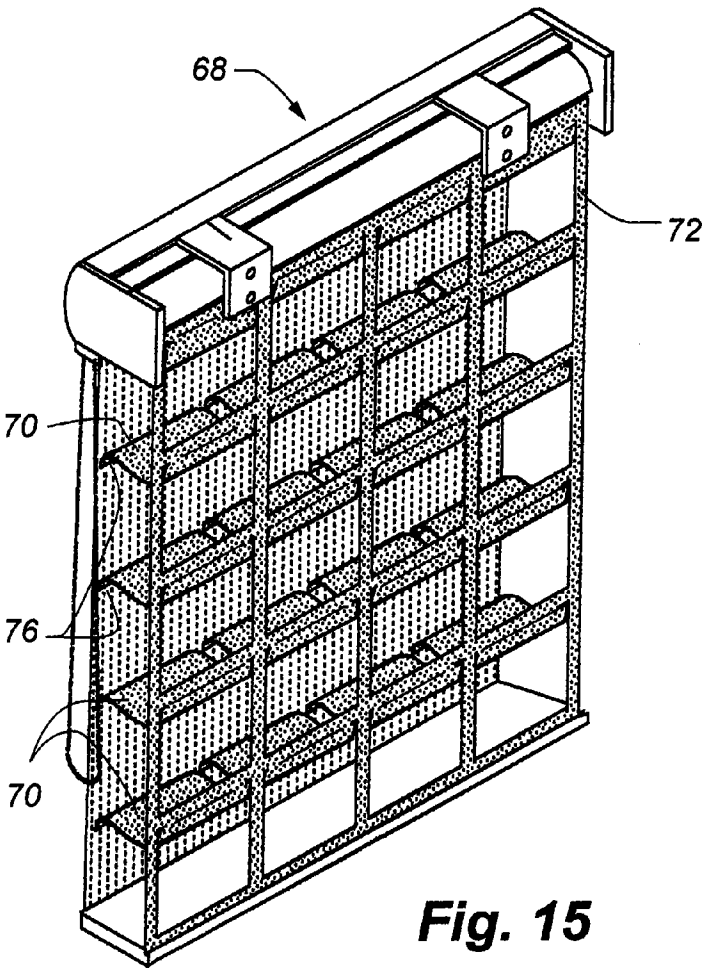
FIG. 15 is an isometric similar to FIG. 14 as viewed from the rear side.
Figure 14:
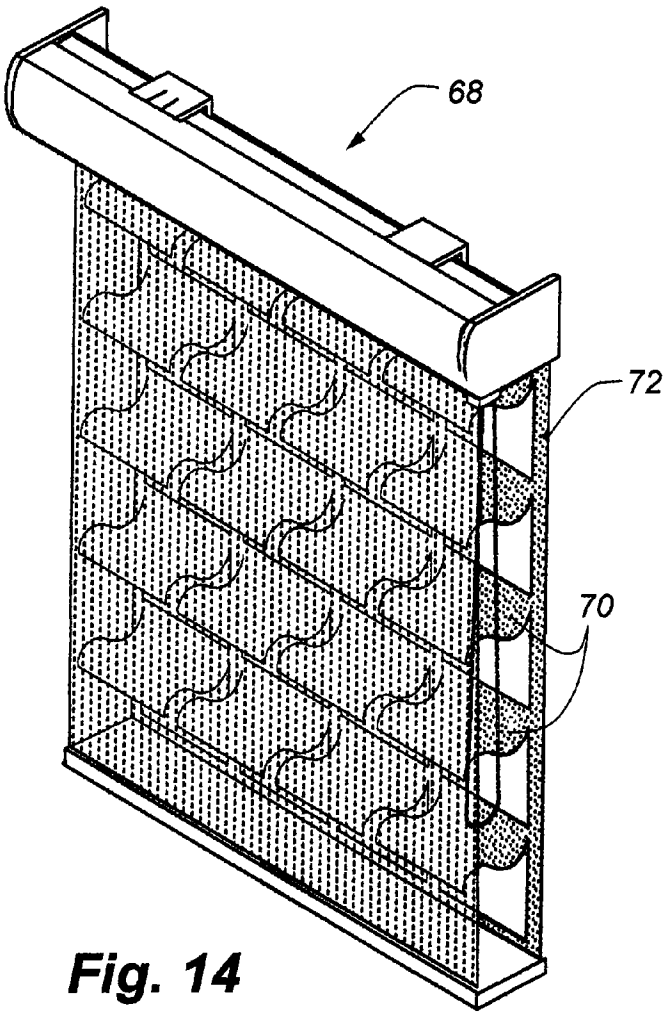
FIG. 14 is a front isometric of the covering of FIG. 12 in a fully extended and fully open position.

FIGS. 14 and 15 show the covering 68 of FIGS. 12 and 13 in a fully extended and fully open position with the bottom rail 44 horizontally oriented and the vanes 70 substantially horizontally oriented even though again they are in reality of generally S-shaped cross-sectional configuration and horizontally disposed due to the fact that the top edge of each vane is integral with the rear sheet from which the vane was cut and the free edge 76 is turned downwardly and secured adhesively or with ultrasonic bonding or the like to the front sheet 74. As with the first-described embodiment, when the front and rear sheets are shifted vertically relative to each other through movement of the roller, the vanes 70 are moved between the closed position of FIGS. 12 and 13 where they are coplanar with the rear sheet and the open position of FIGS. 14 and 15 where they are generally horizontally oriented defining generally square-shaped openings or passages 76 through the rear sheet through which vision and light can pass.

Figure 17:
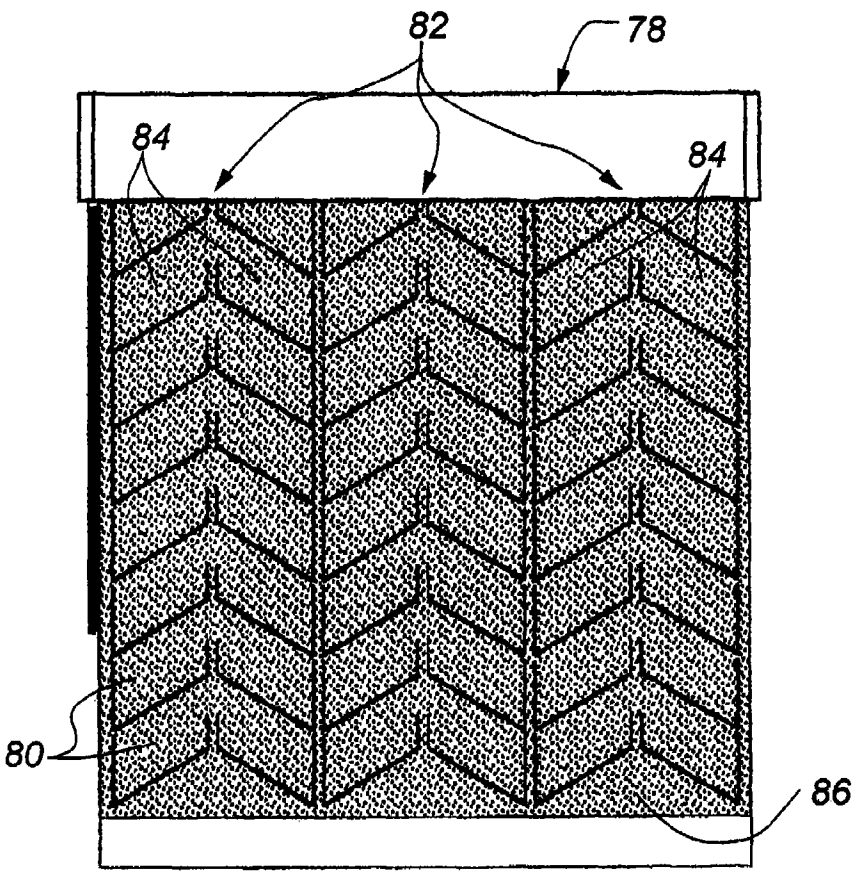
FIG. 17 is a rear elevation similar to FIG. 16 with the covering fully extended and in a fully closed position.
Figure 16:
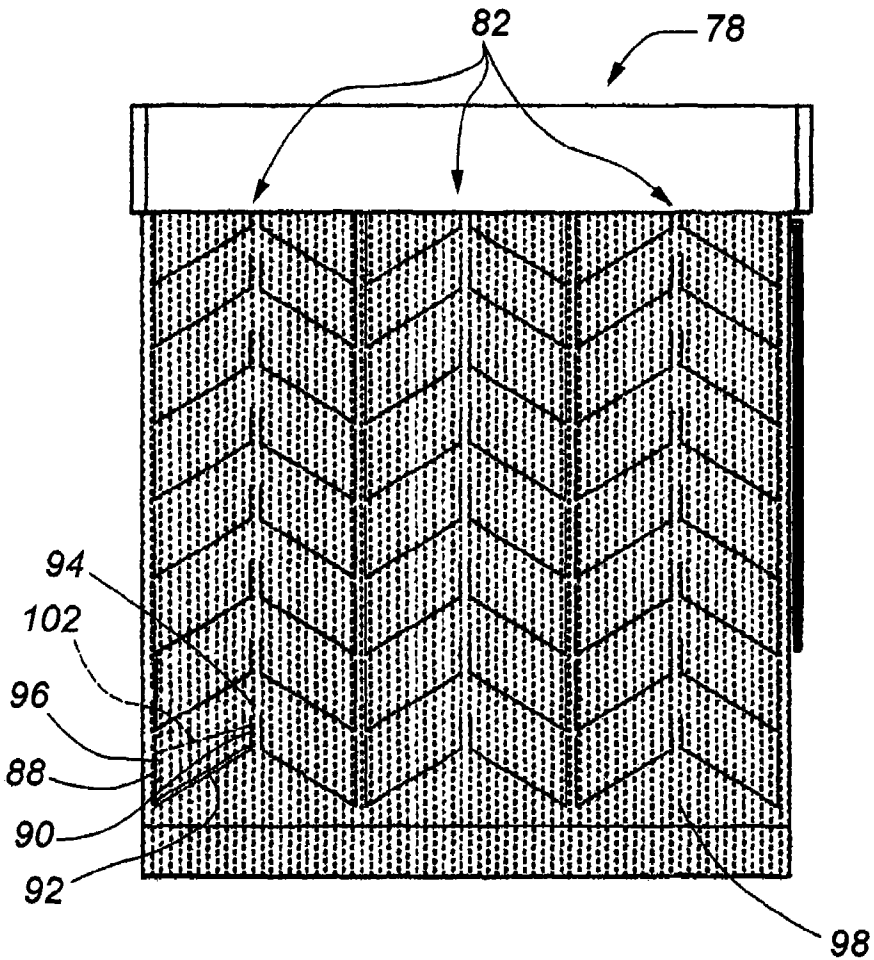
FIG. 16 is a front elevation of a third embodiment of the covering of the present invention with the covering in a fully extended and fully closed position.
Figure 19:
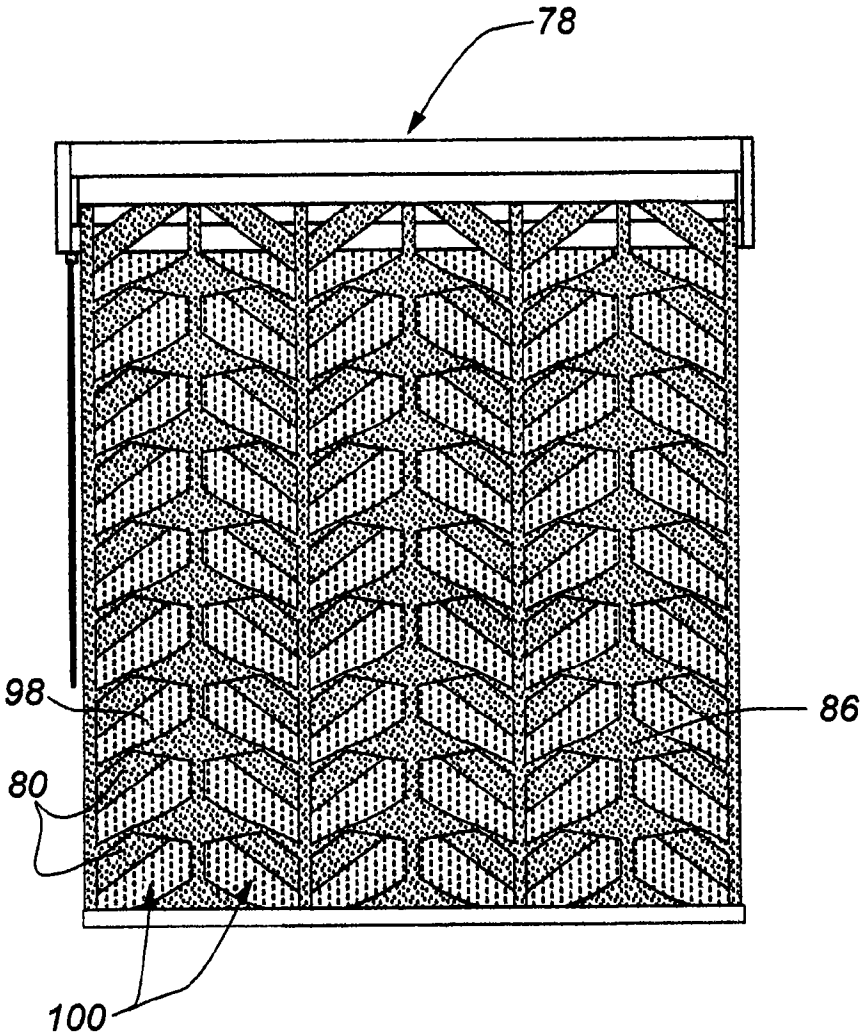
FIG. 19 is a rear elevation similar to FIG. 18 with the covering in a fully extended and fully open position.
Figure 18:
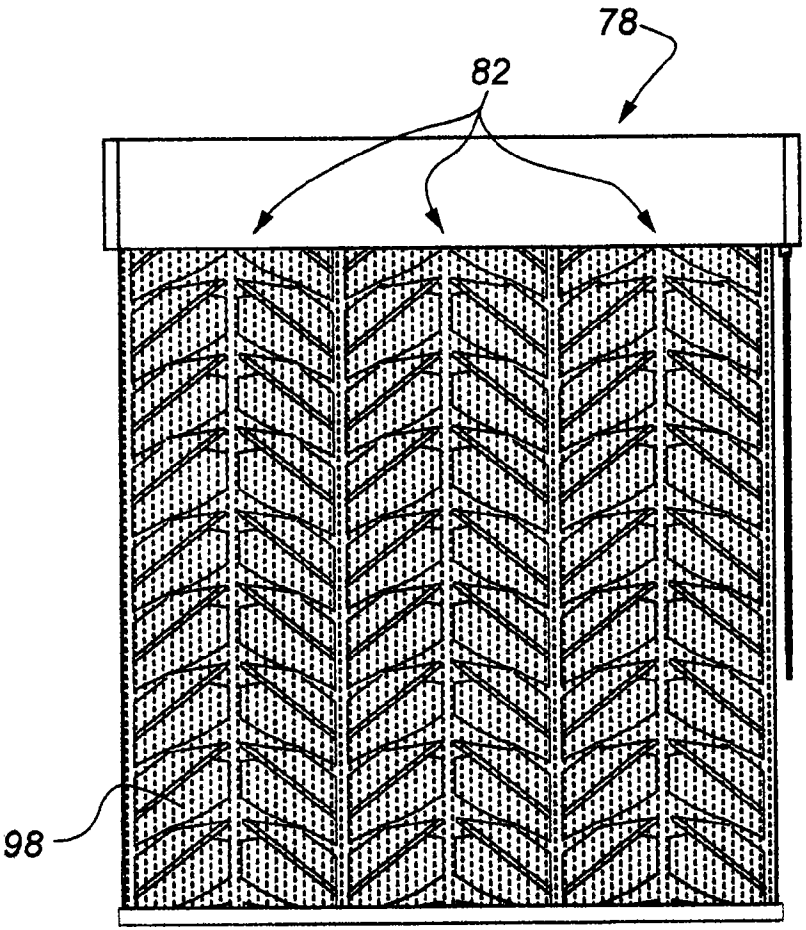
FIG. 18 is a front elevation of the covering of FIG. 16 with the covering fully extended and in a fully open position.
Figure 20:
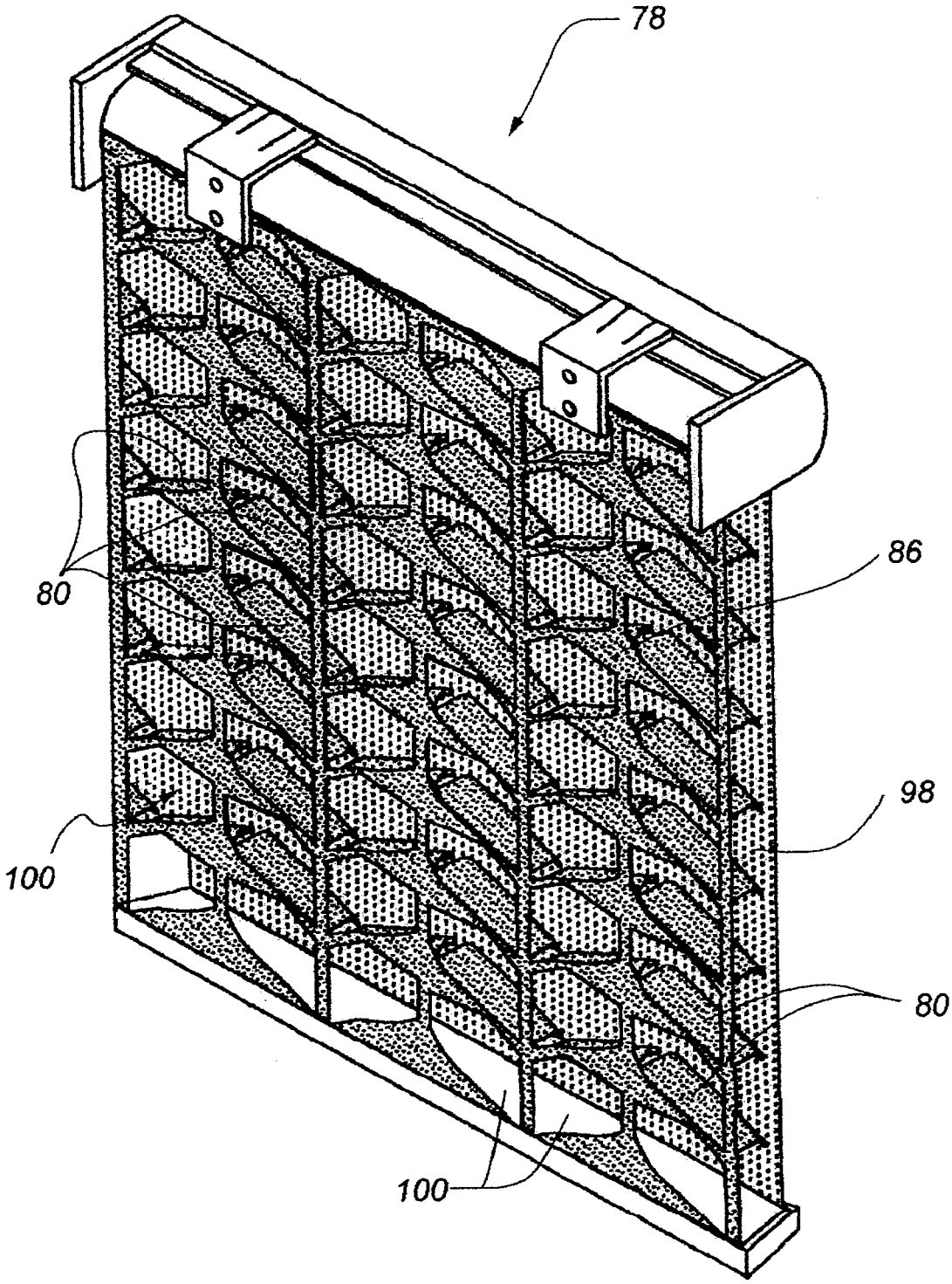
FIG. 20 is a rear isometric of the covering in a fully extended and fully open position.

A third embodiment 78 of the invention is shown in FIGS. 16-20 with this embodiment also working identically to the first two described embodiments only wherein different aesthetics are created by cutting the vanes 80 in a different somewhat trapezoidal pattern. With reference first to FIGS. 16 and 17, which illustrate the covering in the fully extended and closed position, the vanes can be seen to be arranged in three vertical columns 82 with each column having a pair 84 of vanes and with the entire assemblage of vanes, which again are cut from a rear sheet 86, resembling a herring bone pattern. Each vane 80 in a pair of vanes within a column is defined by an outer vertical cut side 88 which is relatively long, an inner vertical cut side 90 which is relatively short and an angled or downwardly inclined lower side 92. As will be appreciated, the top 94 of the shorter inner side 90 is slightly higher than the top 96 of the longer outer side 88 and as will be appreciated from the description that follows, as the vanes are moved from the closed position of FIGS. 16 and 17 to the open position of FIGS. 18-20, the lower cut inclined side 92 of each vane, which is secured to a front sheet is raised with the front sheet to open a hole or passage 100 from whence the vane was cut. Accordingly, the vane 80 folds or pivots about an imaginary hinge line 102, shown in the bottom left corner of FIG. 16 in dashed lines. In other words, when the cut-out vane or tab 80 is moved to the open position by raising its lower edge 92, the vane will pivot about the imaginary hinge line 102 defined between the top edges of its two vertical cut sides.

As is also appreciated by reference to FIGS. 16 and 17, each vane 80 in a pair 84 of vanes within a column 82 of vanes is inclined relative to horizontal and in an opposite horizontally inclined direction from its corresponding vane in a pair. In other words, while one vane of a pair might slope upwardly and to the right, the opposing vane in the pair will slope downwardly and to the right.

When the front 98 and rear 86 sheets are shifted vertically relative to each other with the roller 34 as described in the first embodiment, the bottom rail 44 shifts from a vertical orientation to a horizontal orientation and the front and rear sheets separate horizontally while the vanes 80 are pivoted about the imaginary hinge line 102. The fabric assumes the position shown in FIGS. 18-20 in the open position which of course is a very unusual aesthetic and particularly in comparison to that of the first two described embodiments.

From the above, it will be appreciated numerous aesthetics can be created with a cellular covering having a fabric in accordance with the present invention by creating the cut-out vanes or tabs in any one of an infinite number of configurations and sizes and which cooperate with the front and rear sheets in defining open cells between the front and rear sheets. Further, it will be appreciated the fabric is made from two sheets of material with the vanes being an integral component of one of the sheets. Accordingly, the assembly of the fabric is relatively simple in that the vanes can be first punched or otherwise easily cut from the rear sheet with the free edge of each vane subsequently being secured to the front sheet while the sheets are in a contiguous confronting relationship.

Although the present invention has been described with a certain degree of particularity, it is understood the disclosure has been made by way of example and changes in detail or structure may be made without departing from the spirit of the invention as defined in the appended claims.

The invention claimed is:

1. A retractable covering for an architectural opening comprising in combination:

a flexible fabric including a first sheet and a second sheet parallel to said first sheet, only said second sheet having at least one vane cut therefrom along a discontinuous cut line so as to define an integral hinge along which said vane can be pivoted relative to said second sheet, said vane including a free edge secured to said first sheet, and an operating system supporting said fabric and being operative to move said first and second sheets toward and away from each other such that said vane can be pivoted about said integral hinge as said first and second sheets are moved toward and away from each other.

2. The covering of claim 1 wherein said first sheet is translucent.

3. The covering of claim 1 wherein said integral hinge is along a top edge of said vane.

4. The covering of claim 1 wherein said vane is substantially circular in configuration.

5. The covering of claim 1 wherein said vane is substantially quadrangular in configuration.

6. The covering of claim 1 wherein said vane is substantially trapezoidal in configuration.

7. The covering of claim 1 wherein there are a plurality of said vanes.

8. The covering of claim 7 wherein said vanes are arranged in vertical columns.

9. The covering of claim 8 wherein said vanes are arranged in horizontal rows.

10. The covering of claim 1 wherein said operating system includes a roller about which said fabric can be wrapped and unwrapped when moving the sheets toward and away from each other.

11. The covering of claim 10 wherein said first and second sheets have top edges secured to said roller at different locations along the perimeter of said roller such that pivotal movement of said roller shifts said sheets in opposite vertical directions and horizontally toward and away from each other.

* * * * *